US009097216B2

(12) United States Patent
Itoh et al.

(10) Patent No.: US 9,097,216 B2
(45) Date of Patent: Aug. 4, 2015

(54) FUEL VAPOR PURGE DEVICE

(71) Applicant: DENSO CORPORATION, Kariya, Aichi-pref. (JP)

(72) Inventors: Tomohiro Itoh, Tokai (JP); Kosei Takagi, Novi, MI (US); Shigeru Hasegawa, Nagoya (JP)

(73) Assignee: DENSO CORPORATION, Kariya (JP)

( * ) Notice: Subject to any disclaimer, the term of this patent is extended or adjusted under 35 U.S.C. 154(b) by 217 days.

(21) Appl. No.: 13/945,973

(22) Filed: Jul. 19, 2013

(65) Prior Publication Data

US 2014/0026867 A1 Jan. 30, 2014

(30) Foreign Application Priority Data

Jul. 25, 2012 (JP) ..... 2012-165126

(51) Int. Cl.
*F02M 25/08* (2006.01)

(52) U.S. Cl.
CPC ..... *F02M 25/0854* (2013.01); *F02M 25/0809* (2013.01)

(58) Field of Classification Search
CPC ..... F02M 25/08; F02M 25/0809; F02M 25/0818; F02M 25/0836; F02M 25/0854; F02M 25/0872; F02M 25/089; F02M 37/20; F02M 17/04
See application file for complete search history.

(56) References Cited

U.S. PATENT DOCUMENTS 4,011,721 A * 3/1977 Yip ..... 60/445
5,511,529 A * 4/1996 Blumenstock et al. ..... 123/520
5,890,474 A * 4/1999 Schnaibel et al. ..... 123/520
5,898,103 A * 4/1999 Denz et al. ..... 73/49.2
5,967,124 A * 10/1999 Cook et al. ..... 123/520
6,112,728 A * 9/2000 Schwegler et al. ..... 123/520
6,161,423 A * 12/2000 Okuma ..... 73/40
6,182,642 B1 * 2/2001 Ohkuma ..... 123/520
6,247,458 B1 * 6/2001 Heinemann et al. ..... 123/520
6,321,728 B1 * 11/2001 Ohkuma ..... 123/520
6,527,947 B1 * 3/2003 Channing et al. ..... 210/136
6,550,318 B2 * 4/2003 Isobe et al. ..... 73/114.39
6,679,111 B2 * 1/2004 Shigihama et al. ..... 73/114.39
6,701,777 B2 * 3/2004 Yamaguchi et al. ..... 73/49.7
6,722,348 B2 * 4/2004 Nagasaki et al. ..... 123/520
6,761,154 B2 * 7/2004 Takagi et al. ..... 123/520
6,772,740 B2 * 8/2004 Kojima et al. ..... 123/519
6,786,207 B2 * 9/2004 Kojima et al. ..... 123/516
6,834,535 B2 * 12/2004 Kano et al. ..... 73/49.7
6,912,846 B2 * 7/2005 Huber et al. ..... 60/286
6,959,587 B2 * 11/2005 Schulz et al. ..... 73/49.7

(Continued)

FOREIGN PATENT DOCUMENTS

JP B2-4144407 9/2008

*Primary Examiner* — Stephen K Cronin
*Assistant Examiner* — Kevin R Steckbauer
(74) *Attorney, Agent, or Firm* — Nixon & Vanderhye PC

(57) ABSTRACT

A fuel vapor purge device includes a canister connected to an internal combustion engine and a fuel tank via a purge passage to adsorb and hold a part of fuel vapor, a switch valve connected to the canister and to an atmosphere, and a pump connected to the switch valve via a pump passage and to the atmosphere via an atmosphere passage. The pump is capable of depressurizing or pressurizing an interior of the fuel tank, and the switch valve switches connection of the canister between with the atmosphere and with the pump. The fuel vapor purge device further includes a seal valve provided in the pump passage to open or close the pump passage depending on a pressure in the atmosphere passage.

9 Claims, 8 Drawing Sheets

(56) References Cited

U.S. PATENT DOCUMENTS

| | | | | |
|---|---|---|---|---|
| 6,971,375 | B2 * | 12/2005 | Amano et al. | 123/520 |
| 6,986,341 | B2 * | 1/2006 | Mitani et al. | 123/520 |
| 6,993,957 | B2 * | 2/2006 | Kano et al. | 73/49.7 |
| 7,004,013 | B2 * | 2/2006 | Kobayashi et al. | 73/49.7 |
| 7,059,177 | B2 * | 6/2006 | Kobayashi et al. | 73/114.39 |
| 7,107,759 | B2 * | 9/2006 | Annoura et al. | 60/283 |
| 7,114,372 | B2 * | 10/2006 | Kano et al. | 73/49.7 |
| 7,137,288 | B2 * | 11/2006 | Kobayashi et al. | 73/49.7 |
| 7,162,914 | B2 * | 1/2007 | Streib et al. | 73/49.7 |
| 7,231,813 | B2 * | 6/2007 | Kato et al. | 73/47 |
| 7,237,432 | B2 * | 7/2007 | Inagaki et al. | 73/114.39 |
| 7,255,093 | B2 * | 8/2007 | Iihoshi et al. | 123/518 |
| 7,284,530 | B2 * | 10/2007 | Nagasaki et al. | 123/198 D |
| 7,316,225 | B2 * | 1/2008 | Murakami | 123/520 |
| 7,318,425 | B2 * | 1/2008 | Kano et al. | 123/520 |
| 7,331,335 | B2 * | 2/2008 | Okuda | 123/520 |
| 7,341,048 | B2 * | 3/2008 | Koyama et al. | 123/518 |
| 7,347,194 | B2 * | 3/2008 | Sato | 123/520 |
| 7,350,399 | B2 * | 4/2008 | Kobayashi et al. | 73/49.7 |
| 7,363,803 | B2 * | 4/2008 | Hayakawa et al. | 123/499 |
| 7,370,642 | B2 * | 5/2008 | Amano et al. | 123/520 |
| 7,383,826 | B2 * | 6/2008 | Kano et al. | 123/518 |
| 7,409,947 | B2 * | 8/2008 | Koyama | 123/520 |
| 7,418,953 | B2 * | 9/2008 | Annoura | 123/520 |
| 7,464,698 | B2 * | 12/2008 | Maegawa | 123/519 |
| 7,469,686 | B2 * | 12/2008 | Kano et al. | 123/520 |
| 7,472,583 | B2 * | 1/2009 | Kato et al. | 73/49.7 |
| 7,484,406 | B2 * | 2/2009 | Miyahara | 73/114.39 |
| 7,484,501 | B2 * | 2/2009 | Amano et al. | 123/520 |
| 7,565,900 | B2 * | 7/2009 | Sato et al. | 123/516 |
| 7,610,906 | B2 * | 11/2009 | Takakura et al. | 123/520 |
| 7,762,126 | B2 * | 7/2010 | Shibuya | 73/114.39 |
| 7,966,996 | B1 * | 6/2011 | Pursifull | 123/518 |
| 7,993,119 | B2 * | 8/2011 | Kobayashi et al. | 418/133 |
| 8,033,271 | B2 * | 10/2011 | Yoshimura | 123/520 |
| 8,132,560 | B2 * | 3/2012 | Ulrey et al. | 123/521 |
| 8,155,917 | B2 * | 4/2012 | Maegawa | 702/140 |
| 8,191,536 | B2 * | 6/2012 | Devries et al. | 123/520 |
| 8,327,830 | B2 * | 12/2012 | Makino et al. | 123/518 |
| 8,342,157 | B2 * | 1/2013 | Der Manuelian et al. | 123/521 |
| 8,347,691 | B2 * | 1/2013 | Makino et al. | 73/49.7 |
| 8,397,552 | B2 * | 3/2013 | Jackson et al. | 73/49.3 |
| 8,549,896 | B2 * | 10/2013 | Kobayashi et al. | 73/40.7 |
| 8,551,214 | B2 * | 10/2013 | Dudar et al. | 95/19 |
| 8,560,167 | B2 * | 10/2013 | Jentz et al. | 701/32.7 |
| 8,590,514 | B2 * | 11/2013 | Pursifull | 123/520 |
| 8,627,802 | B2 * | 1/2014 | Horiba et al. | 123/520 |
| 8,630,786 | B2 * | 1/2014 | Jackson et al. | 701/107 |
| 8,800,360 | B2 * | 8/2014 | Itoh et al. | 73/168 |
| 8,850,873 | B2 * | 10/2014 | Itoh et al. | 73/47 |
| 2005/0044938 | A1 * | 3/2005 | Tsuruta et al. | 73/118.1 |
| 2007/0189907 | A1 * | 8/2007 | Kunihiro et al. | 417/44.2 |
| 2008/0092858 | A1 * | 4/2008 | Satoh et al. | 123/520 |
| 2009/0070001 | A1 * | 3/2009 | Takakura et al. | 701/102 |
| 2009/0120284 | A1 * | 5/2009 | Grantham | 95/11 |
| 2011/0123372 | A1 * | 5/2011 | Itoh et al. | 417/410.1 |
| 2012/0130596 | A1 * | 5/2012 | Ooiwa | 701/45 |
| 2012/0240664 | A1 | 9/2012 | Yasuzaka | |
| 2014/0013944 | A1 * | 1/2014 | Haag et al. | 95/146 |
| 2014/0130785 | A1 * | 5/2014 | Levijoki et al. | 123/703 |
| 2014/0336873 | A1 * | 11/2014 | Dudar et al. | 701/33.9 |

* cited by examiner

COMPARATIVE EXAMPLE

COMPARATIVE EXAMPLE

COMPARATIVE EXAMPLE

COMPARATIVE EXAMPLE

FUEL VAPOR PURGE DEVICE

CROSS REFERENCE TO RELATED APPLICATION

This application is based on and incorporates herein by reference Japanese Patent Application No. 2012-165126 filed on Jul. 25, 2012.

TECHNICAL FIELD

The present disclosure relates to a fuel vapor purge device that supplies and purges fuel vapor generated in a fuel tank.

BACKGROUND

Conventionally, a fuel vapor purge device including a seal valve provided in an atmosphere passage connecting a fuel tank and the atmosphere. For example, a fuel vapor purge device described in Patent Document 1 (Japanese Patent No. 4144407) closes a seal valve to seal a fuel tank when an internal combustion engine is stopped, for example. Accordingly, fuel vapor in the fuel tank is prevented from being discharged.

The fuel vapor purge device of Patent Document 1 may require an electromagnetic drive portion for driving a valve element of the seal valve to open or close the seal valve. Therefore, a body of the seal valve may become large, and the fuel vapor purge device may become large. Moreover, manufacturing cost of the fuel vapor purge device may be increased. Additionally, the seal valve is provided between a canister and the fuel tank in the fuel vapor purge device of Patent Document 1. Hence, fuel vapor generated in the fuel tank may attach to the seal valve, and the attachment of fuel vapor to the seal valve may thereby cause operational malfunction of the seal valve.

SUMMARY

It is an objective of the present disclosure to provide a fuel vapor purge device capable of restricting breakage of a fuel tank while keeping the fuel tank air-tight with a simple and compact structure of the fuel vapor purge device.

According to an aspect of the present disclosure, a fuel vapor purge device purges fuel vapor generated in a fuel tank by introducing the fuel vapor into an internal combustion engine. The fuel vapor purge device includes a purge passage, a first canister, a purge valve, a first pump passage, a second pump passage, a third pump passage, a pump, a first atmosphere passage, a second atmosphere passage, a switch valve, a first check valve, a first pressure passage, a seal valve and a control device. The purge passage connects the fuel tank and an intake passage through which intake air is introduced into the internal combustion engine. The first canister is provided in the purge passage to adsorb and hold a part of the fuel vapor flowing in the purge passage. The purge valve is provided in the purge passage near the intake passage to open or close the purge passage. The first pump passage has a first end connected to the first canister. The second pump passage has a first end capable of being connected to a second end of the first pump passage. The third pump passage has a first end capable of being connected to a second end of the second pump passage. The pump is connected to a second end of the third pump passage. The pump is capable of depressurizing or pressurizing an interior of the fuel tank through the third pump passage, the second pump passage, the first pump passage, the first canister and the purge passage. The first atmosphere passage has a first end connected to the pump, and a second end open to an atmosphere. The second atmosphere passage has a first end connected to the first atmosphere passage at a connection point. The switch valve is provided among the second end of the first pump passage, the first end of the second pump passage and a second end of the second atmosphere passage. The switch valve switches connection of the first pump passage between with the second pump passage and with the second atmosphere passage. The first check valve is provided in the first atmosphere passage between the pump and the connection point. The first check valve is open to allow a flow of fluid from the pump toward the atmosphere when a pressure between the first check valve and the pump in the first atmosphere passage is higher than or equal to a first pressure that is a predetermined positive value. The first check valve is closed to block a flow of fluid from the atmosphere toward the pump when the pressure between the first check valve and the pump in the first atmosphere passage is lower than the first pressure. The first pressure passage has a first end connected to a part of the first pressure passage between the pump and the first check valve, and the first pressure passage is pressurized or depressurized by operation of the pump. The seal valve is provided among the second end of the second pump passage, the first end of the third pump passage and a second end of the first pressure passage. The seal valve is open to connect the second pump passage and the third pump passage when a pressure in the first pressure passage is higher than or equal to a second pressure that is a predetermined positive value lower than the first pressure. The seal valve is closed to disconnect the second pump passage from the third pump passage so as to block communication between the interior of the fuel tank and the atmosphere when the pressure in the first pressure passage is lower than the second pressure. The control device is provided to be capable of controlling operations of the purge valve, the pump and the switch valve. The control device is capable of introducing fuel vapor adsorbed to the first canister into the internal combustion engine through the intake passage by opening the purge valve and by controlling the switch valve to connect the first pump passage and the second atmosphere passage.

According to another aspect of the present disclosure, a fuel vapor purge device purges fuel vapor generated in a fuel tank by introducing the fuel vapor into an internal combustion engine. The fuel vapor purge device includes a canister, a switch valve, a pump and a seal valve. The canister is connected to the internal combustion engine and the fuel tank via a purge passage to adsorb and hold a part of the fuel vapor flowing in the purge passage. The switch valve is connected to the canister and to an atmosphere. The pump is connected to the switch valve via a pump passage, and to the atmosphere via an atmosphere passage. The pump is capable of depressurizing or pressurizing an interior of the fuel tank through the switch valve, the canister and the purge passage. The switch valve switches connection of the canister between with the atmosphere and with the pump. The seal valve is provided in the pump passage to open or close the pump passage depending on a pressure in the atmosphere passage.

Accordingly, breakage of a fuel tank can be restricted while keeping the fuel tank air-tight with a simple and compact structure of the fuel vapor purge device.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
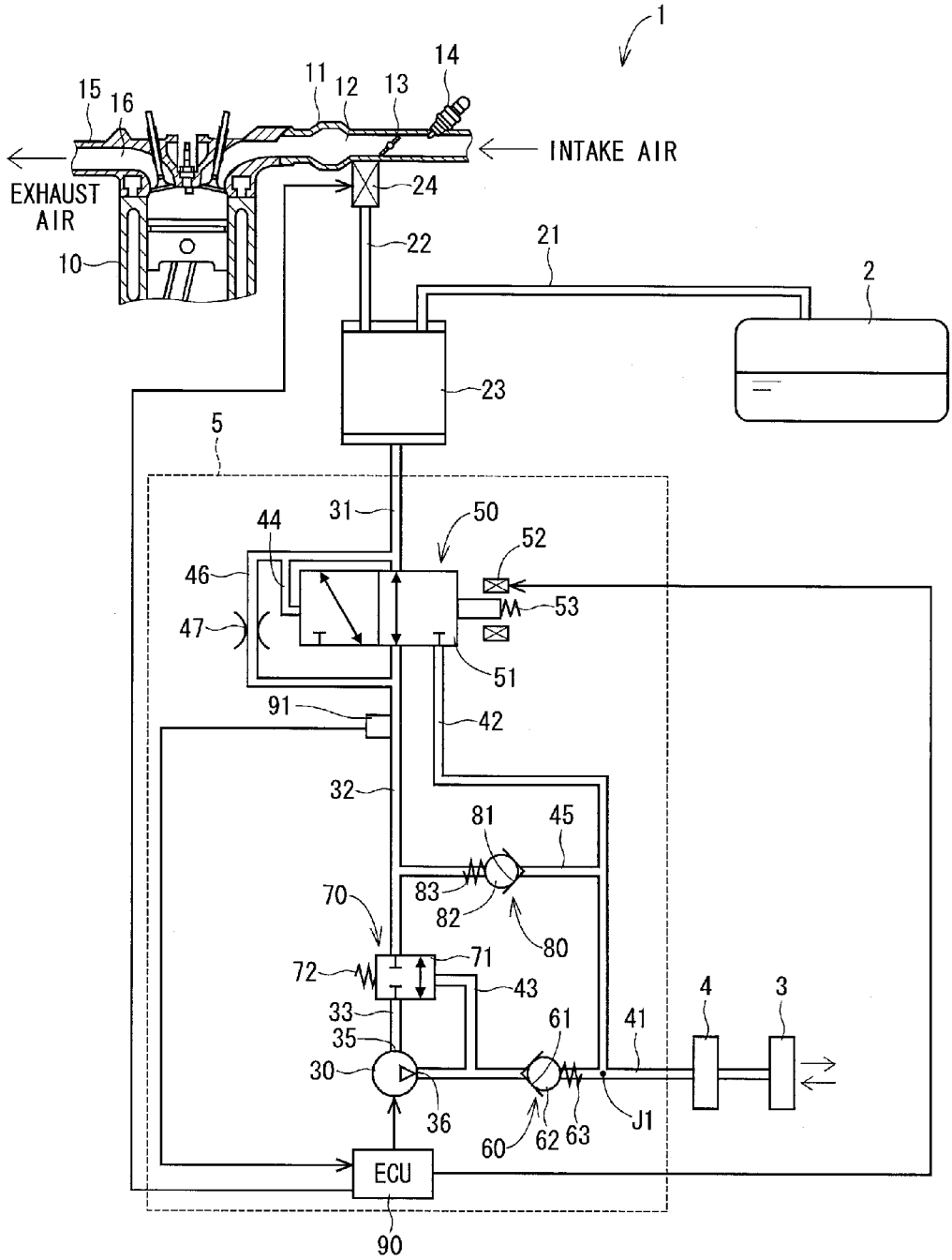
FIG. 1 is a schematic diagram showing a fuel vapor purge device according to an exemplar embodiment of the present disclosure.

An exemplar embodiment of the present disclosure will be described hereinafter referring to drawings.

A fuel vapor purge device 1 of the exemplar embodiment is applied to, for example, an intake-air system of an internal combustion engine 10 disposed in a vehicle. The engine 10 is connected to an intake pipe 11, and the intake pipe 11 defines an intake passage 12 therein. An opposite side of the intake pipe 11 from the engine 10 is open to the atmosphere. Air is drawn into the engine 10 through the intake passage 12. The air drawn into the engine 10 is referred to as intake air.

A throttle valve 13 is provided inside the intake pipe 11, i.e., in the intake passage 12. The throttle valve 13 opens or closes the intake passage 12, thereby being capable of adjusting an amount of the intake air drawn into the engine 10. In the present embodiment, an injector 14 is provided along the intake pipe 11 on an opposite side of the throttle valve 13 from the engine 10. The injector 14 is capable of injecting misty gasoline into the intake passage 12. The gasoline is an example of fuel stored in a fuel tank 2. The fuel injected from the injector 14 into the intake passage 12 is introduced into the engine 10 together with the intake air. The fuel introduced into the engine 10 is combusted in a combustion chamber of the engine 10, and is discharged to the atmosphere through an exhaust passage 16 defined by an exhaust pipe 15. Air containing combustion gas discharged from the engine 10 is referred to as exhaust gas. In the fuel tank 2, vapor of gasoline, i.e., fuel vapor is generated due to evaporation of the stored gasoline.

The fuel vapor purge device 1 includes purge passages 21 and 22, a first canister 23, a purge valve 24, a first pump passage 31, a second pump passage 32, a third pump passage 33, a pump 30, a first atmosphere passage 41, a second atmosphere passage 42, a switch valve 50, a first check valve 60, a first pressure passage 43, a seal valve 70 and an electronic control unit: ECU 90. The fuel vapor purge device 1 is built in the vehicle to purge the fuel vapor generated in the fuel tank 2 by introducing the fuel vapor into the engine 10.

A first end (one end) of the purge passage 21 is connected to the fuel tank 2, and a first end (one end) of the purge passage 22 is connected to the intake passage 12. Second ends (the other ends) of the purge passages 21 and 22 are connected to the first canister 23. Hence, the purge passage 21 and the purge passage 22 connect the fuel tank 2 and the intake passage 12 via the first canister 23 as shown in FIG. 1.

The first canister 23 includes an adsorption member made of, for example, activated carbon. The first canister 23 adsorbs and holds a part of fuel vapor flowing through the purge passages 21 and 22. When the part of the fuel vapor adsorbed and held by the first canister 23 desorbs from the first canister 23, the desorbed fuel vapor flows into the intake passage 12 through the purge passage 22. The first canister 23 is provided for the purpose of limiting of discharge of the fuel vapor to the atmosphere, and limiting of attachment of the fuel vapor to, for example, the pump 30.

The purge valve 24 is, for example, a control valve electromagnetically driven. The purge valve 24 is provided in the purge passage 22 near the intake passage 12. The purge valve 24 is opened or closed to open or close the purge passage 22. The opening or closing of the purge valve 24 cause a flow of fuel vapor flowing in the purge passage 22 from the first canister 23 toward the intake passage 12 to be allowed or blocked. The purge valve 24 is closed in OFF state, and is open in ON state. In other words, the purge valve 24 is used as an example of a normally-closed valve.

A first end (one end) of the first pump passage 31 is connected to the first canister 23. A second end (the other end) of the first pump passage 31 can be connected to a first end (one end) of the second pump passage 32. A second end (the other end) of the second pump passage 32 can be connected to a first end (one end) of the third pump passage 33. A second end (the other end) of the third pump passage 33 is connected to a fluid port 35 of the pump 30. The pump 30 is an electric pump, and is capable of drawing fluid therein through the fluid port 35 and discharging the fluid through a fluid port 36. Alternatively, the pump 30 is capable of drawing fluid therein through the fluid port 36 and discharging the fluid through the fluid port 35. Therefore, the pump 30 is capable of depressurizing or pressurizing an interior of the fuel tank 2 via the third pump passage 33, the second pump passage 32, the first pump passage 31, the first canister 23 and the purge passage 21.

A first end (one end) of the first atmosphere passage 41 is connected to the fluid port 36 of the pump 30, and a second end (the other end) of the first atmosphere passage 41 is open to the atmosphere. A first end (one end) of the second atmosphere passage 42 is connected to the first atmosphere passage 41. In the present embodiment, a filter 3 is provided at the second end of the first atmosphere passage 41. The filter 3 traps foreign objects contained in air flowing into the first atmosphere passage 41 through the second end thereof.

As shown in FIG. 1, the switch valve 50 is provided among the second end of the first pump passage 31, the first end of the second pump passage 32 and a second end (the other end) of the second atmosphere passage 42. The switch valve 50 includes a valve element 51, an electromagnetic drive portion 52 and an urging member 53. The valve element 51 is provided to be reciprocable among the second end of the first pump passage 31, the first end of the second pump passage 32 and the second end of the second atmosphere passage 42. The connection of the first pump passage 31 can be switched between with the second pump passage 32 and with the second atmosphere passage 42 by changing the position of the valve element 51. The electromagnetic drive portion 52 produces a magnetic force by receiving electric power, and thus the electromagnetic drive portion 52 is capable of attracting the valve element 51. The urging member 53 urges the valve element 51 in a direction opposite from the attracting direction of the electromagnetic drive portion 52. When the switch valve 50 is in OFF state, in other words, when no electric power is supplied to the electromagnetic drive portion 52, the switch valve 50 connects the first pump passage 31 and the second pump passage 32 and disconnects the first pump passage 31 from the second atmosphere passage 42. When the switch valve 50 is in ON state, in other words, when electric power is supplied to the electromagnetic drive portion 52, the switch valve 50 connects the first pump passage 31 and the second atmosphere passage 42 and disconnects the first pump passage 31 from the second pump passage 32.

The first check valve 60 is provided in the first atmosphere passage 41 between the pump 30 and a connection point J1 at which the first atmosphere passage 41 is connected to the second atmosphere passage 42. The first check valve 60 includes a valve seat 61, valve element 62 and an urging member 63. The valve seat 61 is provided in the first atmosphere passage 41 to be directed toward the filter 3. The valve element 62 is located on an opposite side of the valve seat 61 from the pump 30, and is contactable with the valve seat 61. The urging member 63 urges the valve element 62 in a valve-closing direction so that the valve element 62 contacts the valve seat 61. When a pressure between the pump 30 and the first check valve 60 in the first atmosphere passage 41 is higher than or equal to a first pressure P1 that is a predetermined positive value, the first check valve 60 is open to allow a flow of fluid from the pump 30 toward the atmosphere. When the pressure between the pump 30 and the first check valve 60 in the first atmosphere passage 41 is lower than the first pressure P1, the first check valve 60 is closed to block the flow of fluid from the atmosphere toward the pump 30. Hereinafter, a pressure higher than an atmosphere pressure is referred arbitrarily to as a positive pressure, and a pressure lower than the atmosphere pressure is referred arbitrarily to as a negative pressure. The first check valve 60 is open when the pressure between the pump 30 and the first check valve 60 in the first atmosphere passage 41 is higher than or equal to a predetermined positive pressure (i.e., when the pressure is higher than or equal to the first pressure P1). The first check valve 60 is closed when the pressure between the pump 30 and the first check valve 60 is lower than the predetermined positive pressure (i.e., when the pressure is lower than the first pressure P1).

A first end of (one end) the first pressure passage 43 is connected to the first atmosphere passage 41 between the pump 30 and the first check valve 60. When the pump 30 is operated, the first atmosphere passage 41 between the pump 30 and the first check valve 60 is pressurized or depressurized. Also the first pressure passage 43 is pressurized or depressurized by the operation of the pump 30. The seal valve 70 is provided among the second end of the second pump passage 32, the first end of the third pump passage 33 and a second end (the other end) of the first pressure passage 43. The seal valve 70 includes a valve element 71 and an urging member 72. The valve element 71 is reciprocable between the second pump passage 32 and the third pump passage 33. Whether the second pump passage 32 is connected to or disconnected from the third pump passage 33 depends on the position of the valve element 71. The urging member 72 urges the valve element 71 in a direction so as to disconnect the second pump passage 32 from the third pump passage 33. The second end of the first pressure passage 43 is located on an opposite side of the valve element 71 from the urging member 72. When a pressure in the first pressure passage 43 is higher than a predetermined value, the valve element 71 moves toward the urging member 72 against an urging force of the urging member 72. Accordingly, the position of the valve element 71 is changed, and thus the seal valve 70 connects the second pump passage 32 and the third pump passage 33.

In the present embodiment, the seal valve 70 is open to connect the second pump passage 32 and the third pump passage 33 when the pressure in the first pressure passage 43 is higher than or equal to a second pressure P2 that is a predetermined positive value lower than the first pressure P1. The seal valve 70 is closed to disconnect the second pump passage 32 from the third pump passage 33 when the pressure in the first pressure passage 43 is lower than the second pressure P2. When the switch valve 50 is in the OFF state, the seal valve 70 is closed to block communication between the atmosphere and the interior of the fuel tank 2. Because the second pressure P2 is set lower than the first pressure P1, the seal valve 70 is opened earlier than the first check valve 60 is opened in accordance with increase of the pressure in the first pressure passage 43 due to operation of the pump 30. A pressurizing capacity of the pump 30, in other words, a largest value of the pressure in the first pressure passage 43 pressurized by the pump 30 is set to be higher than the first pressure P1. Accordingly, the seal valve 70 and the first check valve 60 can be operated as described above.

The ECU 90 is a small size computer including a CPU as a calculating portion, a ROM and RAM as storage portions, and an input and output portions. The ECU 90 controls operations of components and various equipments of the vehicle by using programs stored in the ROM based on signals from sensors provided in the vehicle. The ECU 90 is capable of controlling operations of the purge valve 24, the pump 30 and the switch valve 50 by controlling electric power supplied from a battery to the purge valve 24, the pump 30 and the switch valve 50. The ECU 90 may be used as an example of a control device capable of controlling the purge valve 24, the pump 30 and the switch valve 50.

In the present embodiment, the fuel vapor purge device 1 further includes a second pressure passage 44, a connection passage 45, a second check valve 80, a second canister 4, a pressure sensor 91, an orifice passage 46 and an orifice 47. The pressure sensor 91 may be used as an example of a pressure detection device capable of detecting a pressure in the fuel tank 2, the purge passage 21, 22, the first canister 23, the first pump passage 31, the second pump passage 32 or the third pump passage 33. A first end (one end) of the second pressure passage 44 is connected to the first pump passage 31 between the first canister 23 and the switch valve 50, and a second end (the other end) of the second pressure passage 44 is connected to the switch valve 50. The second end of the second pressure passage 44 is located on an opposite side of the valve element 51 from the urging member 53. When a pressure in the second pressure passage 44 is higher than a predetermined value, the valve element 51 moves toward the urging member 53 against an urging force of the urging member 53. Accordingly, the position of the valve element 51 is changed, and thus the switch valve 50 connects the first pump passage 31 and the second atmosphere passage 42, and disconnects the first pump passage 31 from the second pump passage 32.

In the present embodiment, the switch valve 50 can be operated to connect the first pump passage 31 and the second atmosphere passage 42 when the pressure in the second pressure passage 44 is higher than or equal to a third pressure P3 that is a predetermined positive value. When an internal pressure of the fuel tank 2 becomes an excess positive pressure in the OFF state of the switch valve 50 (i.e., when the internal pressure of the fuel tank 2 is higher than or equal to the third pressure P3), the switch valve 50 can be operated to connect the first pump passage 31 and the second atmosphere passage 42 without applying electrical current to the switch valve 50. Accordingly, the internal pressure (positive pressure) of the fuel tank 2 can be released to the atmosphere, and thus the internal pressure of the fuel tank 2 can be reduced. Therefore, breakage of the fuel tank 2 due to increase of a difference between the internal pressure of the fuel tank 2 and the atmosphere pressure can be prevented.

The connection passage 45 is provided to connect the second pump passage 32 and the second atmosphere passage 42. The second check valve 80 is provided in the connection passage 45. The second check valve 80 includes a valve seat 81, a valve element 82 and an urging member 83. The valve seat 81 is provided in the connection passage 45 to be directed to the second pump passage 32. The valve element 82 is located in the connection passage 45 on an opposite side of the valve seat 81 from the second atmosphere passage 42, and is contactable with the valve seat 81. The urging member 83 urges the valve element 82 in a valve-closing direction so that the valve element 82 contacts the valve seat 81.

The second check valve 80 is open to allow a flow of fluid from the second atmosphere passage 42 toward the second pump passage 32 when, for example, a pressure in the connection passage 45 between the second pump passage 32 and the second check valve 80 is lower than or equal to a fourth pressure P4 that is a predetermined negative value. The second check valve 80 is closed to block a flow of fluid from the second pump passage 32 toward the second atmosphere passage 42 when the pressure in the connection passage 45 between the second pump passage 32 and the second check valve 80 is higher than the fourth pressure P4. Hence, the second check valve 80 is open when the pressure in the connection passage 45 between the second pump passage 32 and the second check valve 80 is lower than or equal to a predetermined negative pressure (i.e., when the pressure in the connection passage 45 between the second pump passage 32 and the second check valve 80 is lower than or equal to the fourth pressure P4). The second check valve 80 is closed when the pressure between the second pump passage 32 and the second check valve 80 in the connection passage 45 is higher than the predetermined negative pressure (i.e., when the pressure in the connection passage 45 between the second pump passage 32 and the second check valve 80 is higher than the fourth pressure P4). When the internal pressure of the fuel tank 2 becomes an excess negative pressure in the OFF state of the switch valve 50 (i.e., when the internal pressure of the fuel tank 2 is lower than or equal to the fourth pressure P4), the second check valve 80 is open to allow a flow of fluid from the second atmosphere passage 42 toward the second pump passage 32. In this case, the internal pressure (negative pressure) of the fuel tank 2 can be released to the atmosphere, and thus the internal pressure of the fuel tank 2 can be increased. Accordingly, breakage of the fuel tank 2 due to increase of a difference between the internal pressure of the fuel tank 2 and the atmosphere pressure can be prevented. In the present embodiment, the urging force of the urging member 63 of the first check valve 60, the urging force of the urging member 72 of the seal valve 70, the urging force of the urging member 53 of the switch valve 50, and the urging force of the urging member 83 of the second check valve 80 are set to satisfy relationships: $|P2|<|P1|<|P3|$; and $|P2|<|P1|<|P4|$.

The second canister 4 is provided on an atmosphere side of the connection point J1 at which the first atmosphere passage 41 is connected to the second atmosphere passage 42. In other words, the second canister 4 is located in the first atmosphere passage 41 between the connection point J1 and the filter 3. The canister 4 is capable of adsorbing and holding fuel vapor desorbed from the first canister 23. The pressure sensor 91 is provided in the second pump passage 32 in the present embodiment, and is capable of detecting a pressure in the second pump passage 32. The pressure sensor 91 outputs a signal relevant to a detected pressure to the ECU 90. Accordingly, the ECU 90 is capable of detecting the pressure in the second pump passage 32.

The orifice passage 46 connects the first pump passage 31 and the second pump passage 32 while bypassing the switch valve 50. The orifice 47 is provided in the orifice passage 46. The orifice 47 has a size corresponding to an allowable leakage amount of fuel vapor from the fuel tank 2. For example, accuracy of detection of fuel leakage from an opening having a diameter $\phi$ 0.5 mm is required by standards of Environmental Protection Agency: EPA and California Air Resources Board: CARB. Therefore, in the present embodiment, the orifice 47 provided in the orifice passage 46 has an opening having a diameter smaller than or equal to $\phi$ 0.5 mm, for example.

Operations of the fuel vapor purge device 1 of the exemplar embodiment will be described below with reference to FIGS. 1 to 4.

(Normal State)

As shown in FIG. 1, the purge valve 24, the pump 30 and the switch valve 50 are in OFF state in a normal state of the fuel vapor purge device 1. For example, operations of the vehicle and the engine 10 are stopped in the normal state. In this case, the purge valve 24 is closed, and the pump 30 is not operated. The switch valve 50 connects the first pump passage 31 and the second pump passage 32, and disconnects the first pump passage 31 from the second atmosphere passage 42. Fuel vapor generated in the fuel tank 2 flows through the purge passage 21, and is adsorbed to and held by the first canister 23. The seal valve 70 is closed to disconnect the second pump passage 32 from the third pump passage 33. Thus, in this case, the seal valve 70 is used as an example of a sealing device that blocks communication between the interior of the fuel tank 2 and the atmosphere to prevent release of the fuel vapor from the fuel tank 2 to the atmosphere when the purge valve 24, the pump 30 and the switch valve 50 are in the OFF state. When fuel is fed to the fuel tank 2, the ECU 90 puts the switch valve 50 into ON state to make the interior of the fuel tank 2 communicate with the atmosphere. Accordingly, fuel-feeding characteristic can be improved.

(Fuel-Vapor Purge State)

Figure 2:
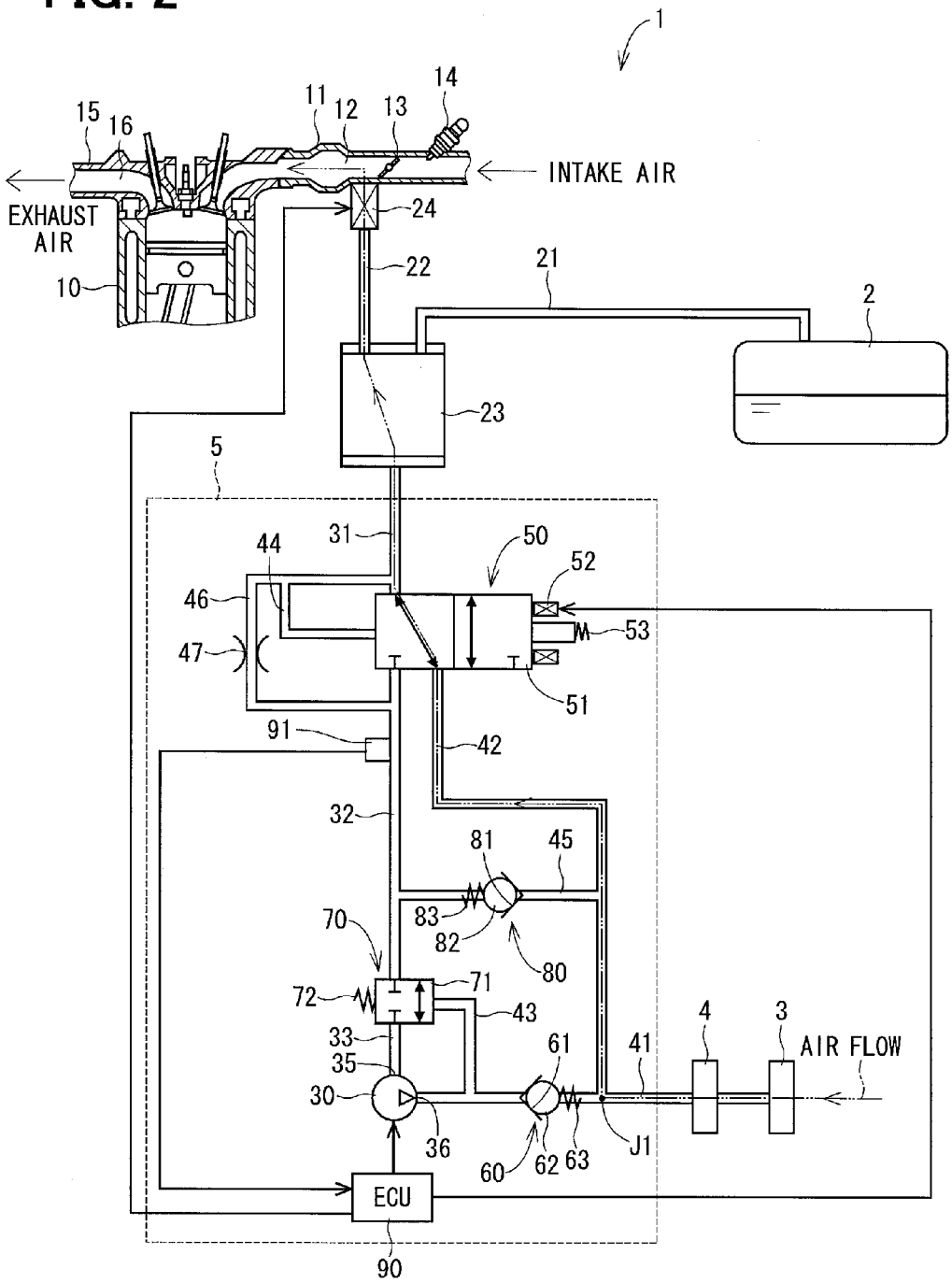
FIG. 2 is a schematic diagram showing a fuel-vapor purge state of the fuel vapor purge device according to the exemplar embodiment.

As shown in FIG. 2, the purge valve 24 is put into ON state by the ECU 90 to be open when a pressure in the intake passage 12 of the intake pipe 11 is negative during operation of the engine 10. Accordingly, fuel vapor adsorbed to the first canister 23 can be drawn into the intake passage 12 of the intake pipe 11, and can be introduced into the engine 10 through the intake passage 12. The fuel vapor generated in the fuel tank 2 can be purged by combustion of the fuel vapor in the engine 10. The ECU 90 calculates a target purge amount of the fuel vapor based on an operating condition of the engine 10, and controls an operation of the purge valve 24 based on the target purge amount.

When the purge valve 24 is opened to purge the fuel vapor, the switch valve 50 is put into ON state by the ECU 90 to connect the first pump passage 31 and the second atmosphere passage 42. Thus, when the fuel vapor is purged, air flows into the first canister 23 through the first atmosphere passage 41, the second atmosphere passage 42 and the first pump passage 31. As a result, the fuel vapor adsorbed to the first canister 23 can be purged smoothly. As described above, since the ECU 90 opens the purge valve 24 and controls the switch valve 50 to connect the first pump passage 31 and the second atmosphere passage 42, the fuel vapor adsorbed to the first canister 23 can be introduced into the engine 10 through the intake passage 12.

(Reference-Pressure Detection State)

Figure 3:
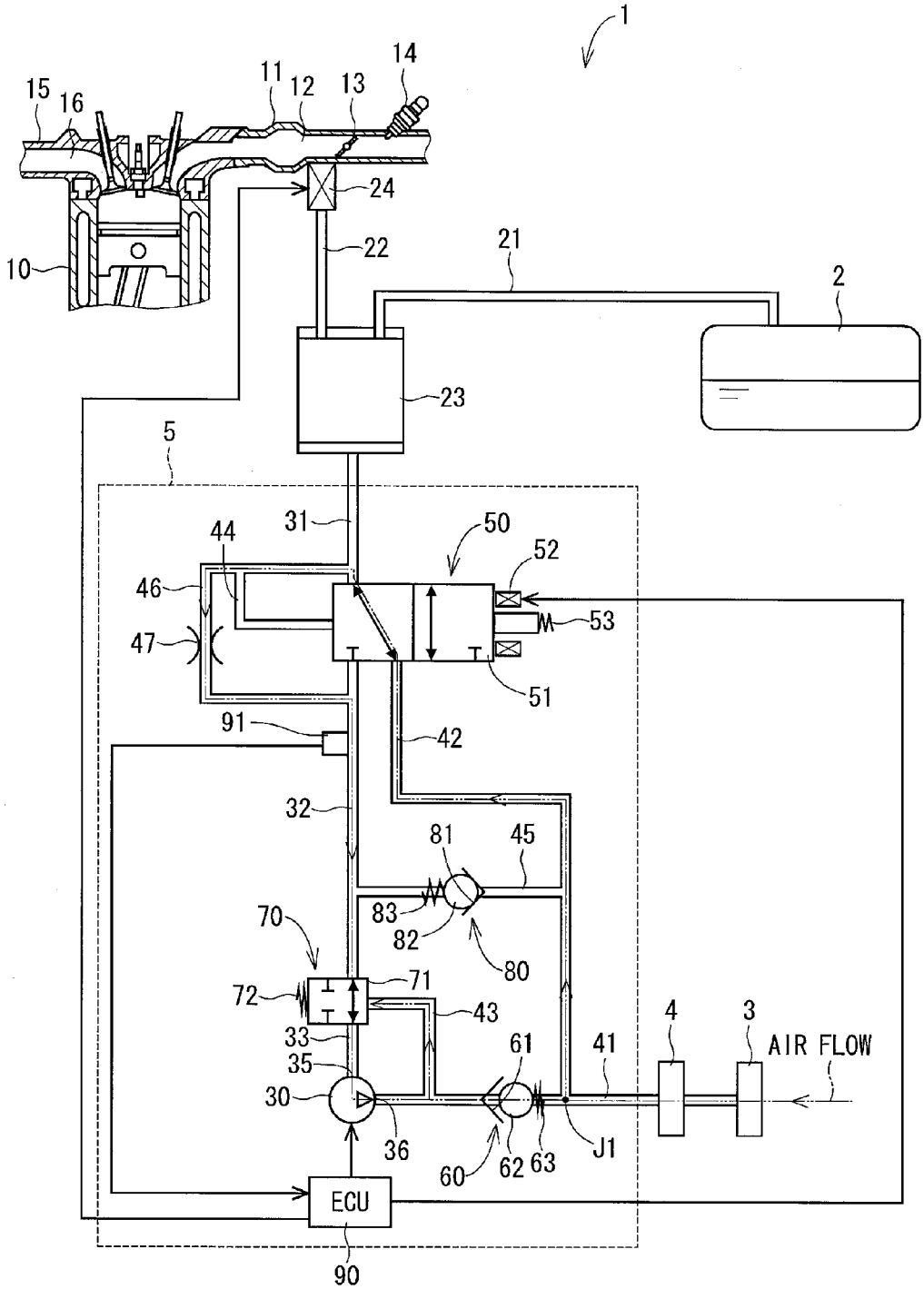
FIG. 3 is a schematic diagram showing a reference-pressure detection state of the fuel vapor purge device according to the exemplar embodiment.

As shown in FIG. 3, when the vehicle and the engine 10 are stopped, and when temperatures of the engine 10 and the fuel tank 2 become stability temperatures lower than or equal to a predetermined value, the ECU 90 closes the purge valve 24. Additionally, the ECU 90 puts the switch valve 50 into ON state to connect the first pump passage 31 and the second atmosphere passage 42, and operates the pump 30 such that fluid is drawn into the pump 30 through the fluid port 35 and the drawn fluid is discharged from the pump 30 through the fluid port 36. Accordingly, the first atmosphere passage 41 between the pump 30 and the first check valve 60 is pressurized, and the first pressure passage 43 is pressurized.

When a pressure in the first pressure passage 43 becomes higher than or equal to a predetermined positive pressure (i.e., the pressure in the first pressure passage 43 becomes higher than or equal to the second pressure P2), the seal valve 70 is opened to connect the second pump passage 32 and the third pump passage 33. When the pressure in the first pressure passage 43, i.e., a pressure in the first atmosphere passage 41 between the pump 30 and the first check valve 60 is further increased and becomes higher than or equal to a predetermined positive pressure (i.e., the pressure in the first pressure passage 43 becomes higher than or equal to the first pressure P1), the first check valve 60 is opened to allow a flow of fluid from the pump 30 toward the atmosphere. Hence, air flows into the first atmosphere passage 41 through the filter 3, and then passes through the second atmosphere passage 42, the switch valve 50, the first pump passage 31, the orifice passage 46, the orifice 47, the second pump passage 32, the seal valve 70, the third pump passage 33, the pump 30, the first atmosphere passage 41 and the first check valve 60 in this order. Accordingly, an air flow can be provided, which circulates through the second atmosphere passage 42, the first pump passage 31, the orifice passage 46, the orifice 47, the second pump passage 32, the third pump passage 33, the first atmosphere passage 41 and the first check valve 60. In this case, a pressure in the second pump passage 32 is comparable to an allowable internal pressure of the fuel tank 2. The allowable internal pressure is a pressure in the fuel tank 2 when the pump 30 depressurizes the interior of the fuel tank 2 in a case where the fuel tank 2 has an opening having a size corresponding to the allowable leakage amount of fuel vapor. Thus, the pressure in the second pump passage 32 detected by the pressure sensor 91 is stored in the RAM or another storage device by the ECU 90 as a reference pressure Ps that is negative pressure.

(Leakage Determination State)

Figure 4:
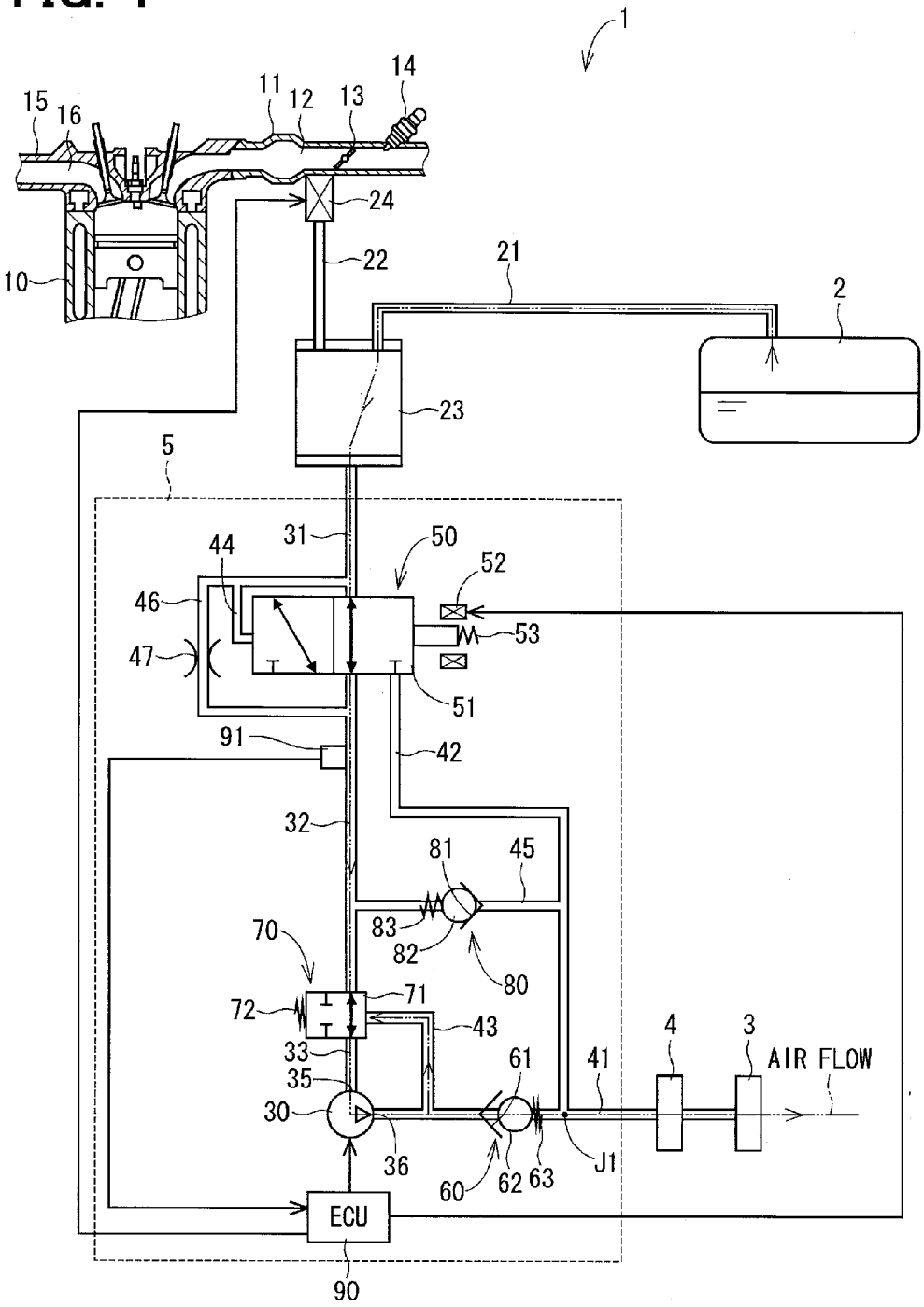
FIG. 4 is a schematic diagram showing a leakage determination state of the fuel vapor purge device according to the exemplar embodiment.

After the above-described detection of the reference pressure Ps, as shown in FIG. 4, the ECU 90 puts the switch valve 50 into OFF state while operating the pump 30. The seal valve 70 and the first check valve 60 are open, and the switch valve 50 connects the first pump passage 31 and the second pump passage 32. Thus, air in the fuel tank 2 is discharged to the atmosphere through the purge passage 21, the first pump passage 31, the switch valve 50, the second pump passage 32, the seal valve 70, the third pump passage 33, the pump 30, the first atmosphere passage 41, the first check valve 60, the second canister 4 and the filter 3. Therefore, the interior of the fuel tank 2 is depressurized. When the pressure in the second pump passage 32 detected by the pressure sensor 91 is lower than or equal to the reference pressure Ps, the ECU 90 determines that a leakage of fuel vapor from the fuel tank 2 is within an allowable range, in other words, the ECU 90 determines that fuel vapor in the fuel tank 2 does not leak. On the other hand, when the pressure in the second pump passage 32 detected by the pressure sensor 91 is higher than the reference pressure Ps, the ECU 90 determines that the leakage of fuel vapor from the fuel tank 2 exceeds the allowable range, in other words, the ECU 90 determines that fuel vapor leaks from the fuel tank 2. When the leakage of fuel vapor is determined to exceed the allowable range, the ECU 90 alerts a driver that fuel vapor leaks from the fuel tank 2 by, for example, turning on a warning light in the present embodiment.

When the pump 30 depressurizes the interior of the fuel tank 2, and when the leakage of fuel vapor from the fuel tank 2 exceeds the allowable range, the pressure in the fuel tank 2 is negative and is held in equilibrium while the seal valve 70 and the first check valve 60 are open. On the other hand, when the leakage of fuel vapor from the fuel tank 2 is within the allowable range, and when the pressure in the fuel tank 2 becomes lower than or equal to the reference pressure Ps, the ECU 90 stops the operation of the pump 30 or opens the second check valve 80 in order to prevent breakage of the fuel tank 2. Alternatively, the second check valve 80 may be opened, so that the pressure in the fuel tank 2 is negative and is held in equilibrium. When the pump 30 is stopped after the fuel-vapor leakage determination (leakage check) is finished, the pressure in the first pressure passage 43, i.e., the pressure in the first atmosphere passage 41 between the pump 30 and the first check valve 60 decreases. As a result, the seal valve 70 is closed. Thus, the pressure in the first pressure passage 43, i.e., the pressure in the first atmosphere passage 41 between the pump 30 and the first check valve 60 is kept at the second pressure P2. In other words, the seal valve 70 is closed while the first pressure passage 43 and the first atmosphere passage 41 between the pump 30 and the first check valve 60 are in positive-pressure states. When the seal valve 70 is closed, the fuel tank 2 and the third pump passage 33 are in negative-pressure states. Consequently, the fuel tank 2 is sealed with being kept in the negative-pressure state.

When an excess positive pressure in the fuel tank 2 is released, or when the interior of the fuel tank 2 is put into the negative-pressure state in the fuel-vapor leakage determination, fuel vapor may pass through the first canister 23 or/and the second canister 4. However, if the first canister 23 or the second canister 4 is damaged (broken), the fuel vapor may be emitted to the atmosphere. Since the first canister 23 may be damaged easily, the fuel tank 2 may be kept in the negative-pressure state as described above.

As described above, the pressure sensor 91 detects pressures including the reference pressure Ps while the first check valve 60 and the seal valve 70 are opened by operating the pump 30. The ECU 90 is capable of determine whether the leakage of fuel vapor from the fuel tank 2 is within the allowable range based on the pressures (reference pressure Ps) detected by the pressure sensor 91. The ECU 90 together with the switch valve 50, the pump 30, the first check valve 60, the seal valve 70, the orifice 47 and the pressure sensor 91 is used as an example of a fuel-vapor leakage detection device 5 which detects leakage of fuel vapor from the fuel tank 2.

Figure 5:
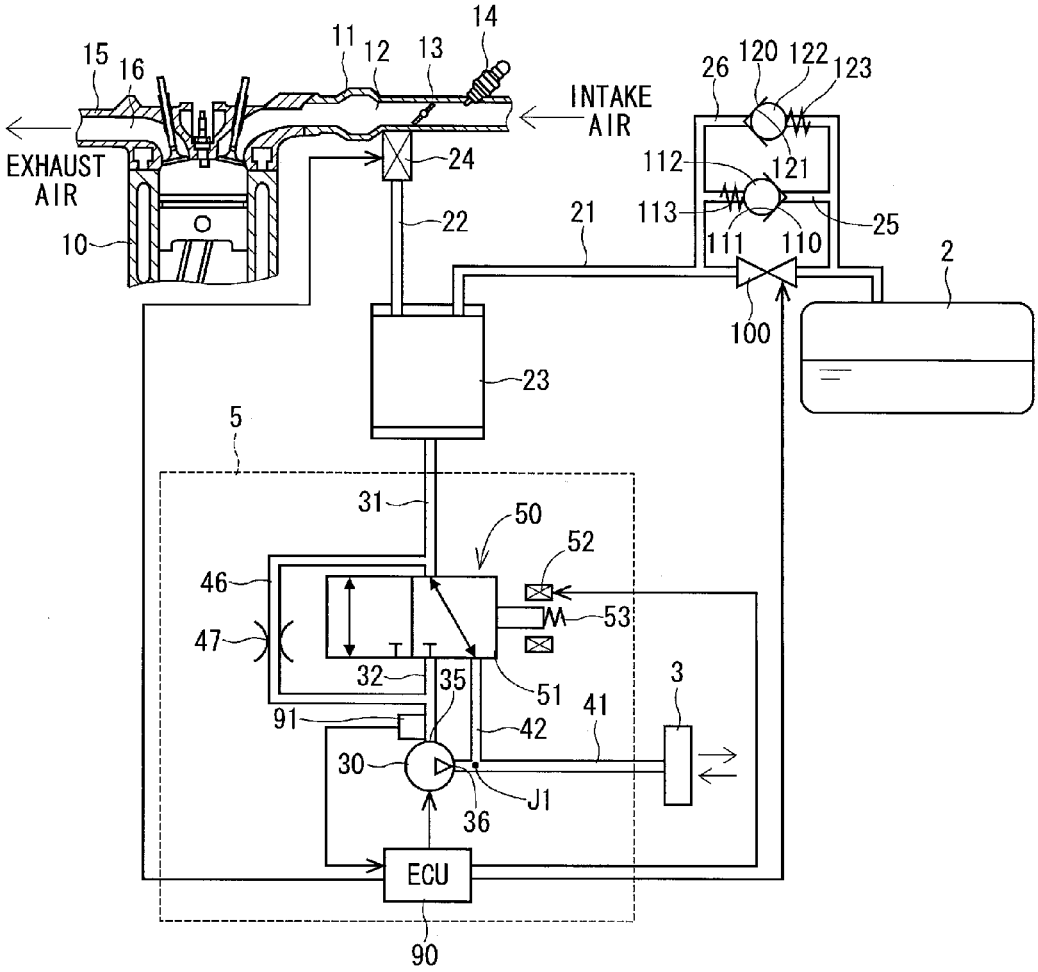
FIG. 5 is a schematic diagram showing a fuel vapor purge device according to a comparative example.

Next, a fuel vapor purge device of a comparative example will be described referring to FIGS. 5 to 8, and advantageous points of the above exemplar embodiment over the comparative example will be clarified. As shown in FIG. 5, the comparative example does not include the third pump passage 33, the first pressure passage 43, the second pressure passage 44, the connection passage 45, the first check valve 60, the seal valve 70, the second check valve 80 and the second canister 4, as compared with the above-described exemplar embodiment. The fluid port 35 of the pump 30 is connected to the second end of the second pump passage 32.

In the comparative example, when the switch valve 50 is in OFF state, the switch valve 50 connects the first pump passage 31 and the second atmosphere passage 42, and disconnects the first pump passage 31 from the second pump passage 32, unlike with the exemplar embodiment of the present disclosure. When the switch valve 50 is in ON state, the switch valve 50 connects the first pump passage 31 and the second pump passage 32, and disconnects the first pump passage 31 from the second atmosphere passage 42. The fuel vapor purge device of the comparative example, unlike with the exemplar embodiment, includes a control valve 100, a first bypass passage 25, a second bypass passage 26, a check valve 110 and a check valve 120.

The control valve 100 is, for example, driven electromagnetically, and is provided in the purge passage 21. The control valve 100 opens or closes the purge passage 21, in other words, the control valve 100 is opened or closed, thereby allowing or blocking a flow of fuel vapor flowing from the fuel tank 2 to the first canister 23 in the purge passage 21. The control valve 100 is a normally-closed valve that is closed in OFF state and is open in ON state. In the comparative example, even when the switch valve 50 is put into OFF state to connect the first pump passage 31 and the second atmosphere passage 42, communication between the fuel tank 2 and the atmosphere is blocked in OFF state of the control valve 100. Therefore, in the comparative example, the control valve 100 functions as a sealing device that prevents discharge of fuel vapor from the fuel tank 2 to the atmosphere. The first bypass passage 25 and the second bypass passage 26 are connected to the purge passage 21 so as to bypass the control valve 100. Specifically, a part of the purge passage 21 located between the first canister 23 and the control valve 100 is connected to a part of the purge passage 21 located between the fuel tank 2 and the control valve 100 through the first and second bypass passages 25 and 26.

The check valve 110 is provided in the first bypass passage 25. The check valve 110 includes a valve seat 111, a valve element 112 and an urging member 113. The urging member 113 urges the valve element 112 in a valve-closing direction so that the valve element 112 contacts the valve seat 111. The valve element 112 is separated from the valve seat 111 against an urging force of the urging member 113 when a pressure in the first bypass passage 25 between the check valve 110 and the fuel tank 2, i.e., an internal pressure of the fuel tank 2 is higher than or equal to a predetermined positive pressure (fifth pressure P5). In other words, the check valve 110 is opened when the internal pressure of the fuel tank 2 is higher than or equal to the predetermined positive pressure. Accordingly, the internal pressure in the fuel tank 2 decreases. On the other hand, the valve element 112 is urged toward the valve seat 111 by the urging force of the urging member 113, and contacts the valve seat 111 when the pressure in the first bypass passage 25 between the check valve 110 and the fuel tank 2 is lower than the predetermined positive pressure (fifth pressure P5). In other words, the check valve 110 is closed when the internal pressure of the fuel tank 2 is lower than the predetermined positive pressure.

The check valve 120 is provided in the second bypass passage 26. The check valve 120 includes a valve seat 121, a valve element 122 and an urging member 123. The urging member 123 urges the valve element 122 in a valve-closing direction so that the valve element 122 contacts the valve seat 121. The valve element 122 is separated from the valve seat 121 against an urging force of the urging member 123 when a pressure in the second bypass passage 26 between the check valve 120 and the fuel tank 2, i.e., the internal pressure of the fuel tank 2 is lower than or equal to a predetermined negative pressure (sixth pressure P6). In other words, the check valve 120 is opened when the internal pressure of the fuel tank 2 is lower than or equal to the predetermined negative pressure. Accordingly, the internal pressure in the fuel tank 2 increases. On the other hand, the valve element 122 is urged toward the valve seat 121 by the urging force of the urging member 123, and contacts the valve seat 121 when the pressure in the second bypass passage 26 between the check valve 120 and the fuel tank 2 is higher than the predetermined negative pressure (sixth pressure P6). In other words, the check valve 120 is closed when the internal pressure of the fuel tank 2 is higher than the predetermined negative pressure.

In the comparative example, the check valve 110 and the check valve 120 are opened or closed depending on change of the internal pressure of the fuel tank 2. Accordingly, breakage of the fuel tank 2 due to increase of pressure difference between the internal pressure of the fuel tank 2 and the atmosphere pressure is restricted.

Next, operations of the fuel vapor purge device of the comparative example will be described with reference to FIGS. 5 to 8.

(Normal State)

As shown in FIG. 5, the purge valve 24, the pump 30, the switch valve 50 and the control valve 100 are in OFF states in a normal state. For example, operations of the vehicle and the engine 10 are stopped in the normal state. In this case, the purge valve 24 is closed, and the pump 30 is not operated. The switch valve 50 connects the first pump passage 31 and the second atmosphere passage 42, and disconnects the first pump passage 31 from the second pump passage 32. Additionally, the control valve 100 is closed. When the purge valve 24, the pump 30 and the switch valve 50 are in the OFF states as described above, the control valve 100 is closed to block communication between the interior of the fuel tank 2 and the atmosphere and to function as a sealing device that prevents discharge of fuel vapor from the fuel tank 2 to the atmosphere. In the comparative example, the ECU 90 arbitrarily puts the control valve 100 into ON state such that fuel vapor in the fuel tank 2 flows into the first canister 23 through the purge passage 21. Accordingly, the fuel vapor is adsorbed to and held by the first canister 23. When fuel is fed to the fuel tank 2, the ECU 90 puts the control valve into the ON state such that the interior of the fuel tank 2 communicates with the atmosphere. Therefore, fuel-feeding characteristic can be improved.

(Fuel-Vapor Purge State)

Figure 6:
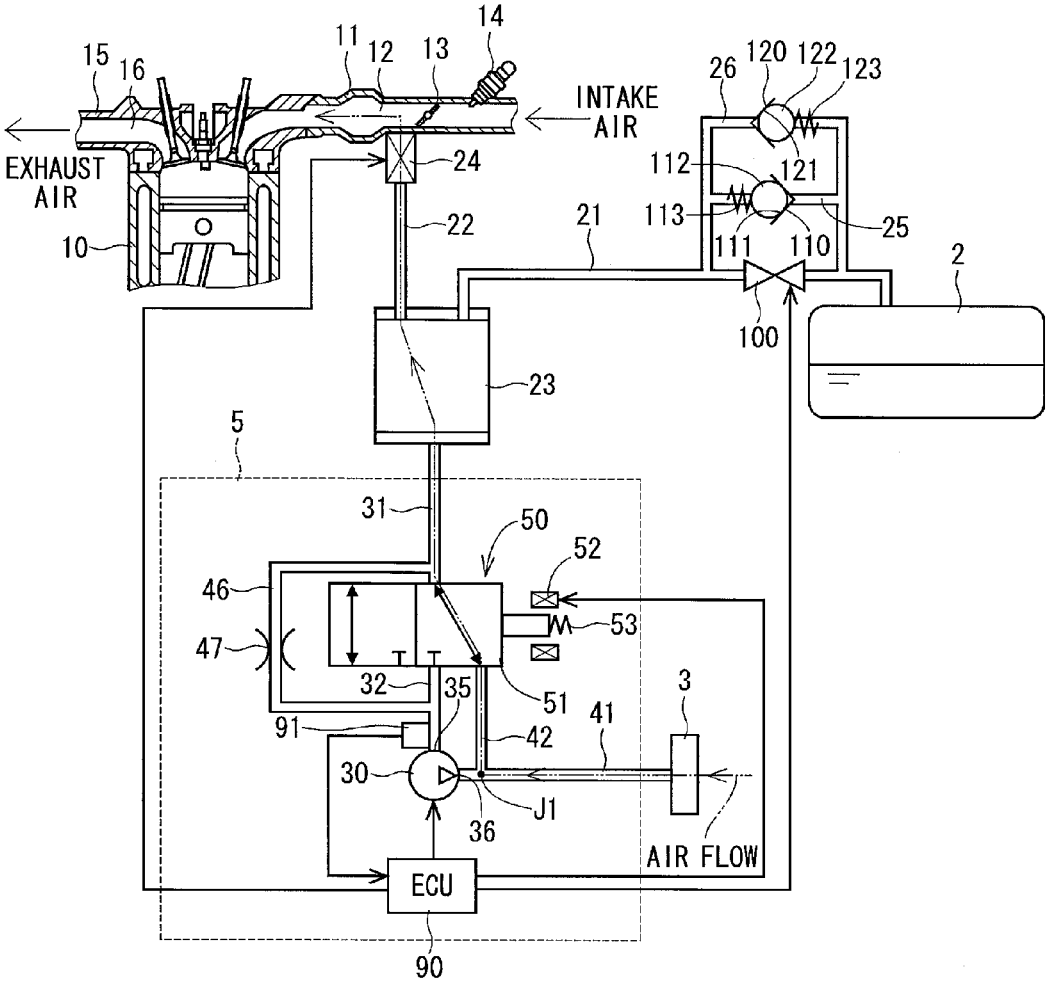
FIG. 6 is a schematic diagram showing a fuel-vapor purge state of the fuel vapor purge device according to the comparative example.

As shown in FIG. 6, the purge valve 24 is put into ON state by the ECU 90 to be open when a pressure in the intake passage 12 of the intake pipe 11 is negative during operation of the engine 10. In this case, fuel vapor adsorbed to the first canister 23 can be drawn into the intake passage 12 of the intake pipe 11, and can be introduced into the engine 10 through the intake passage 12. Accordingly, the fuel vapor generated in the fuel tank 2 can be purged by combustion of the fuel vapor in the engine 10. The ECU 90 calculates a target purge amount of the fuel vapor based on an operating condition of the engine 10, and controls an operation of the purge valve 24 based on the target purge amount.

When the purge valve 24 is opened to purge the fuel vapor, the switch valve 50 is put into ON state by the ECU 90 to connect the first pump passage 31 and the second atmosphere passage 42. Accordingly, air flows into the first canister 23 through the first atmosphere passage 41, the second atmosphere passage 42 and the first pump passage 31 when the fuel vapor is purged. As a result, the fuel vapor adsorbed to the first canister 23 can be purged smoothly. The ECU 90 may open the control valve 100 when the fuel vapor is purged.

(Reference-Pressure Detection State)

Figure 7:
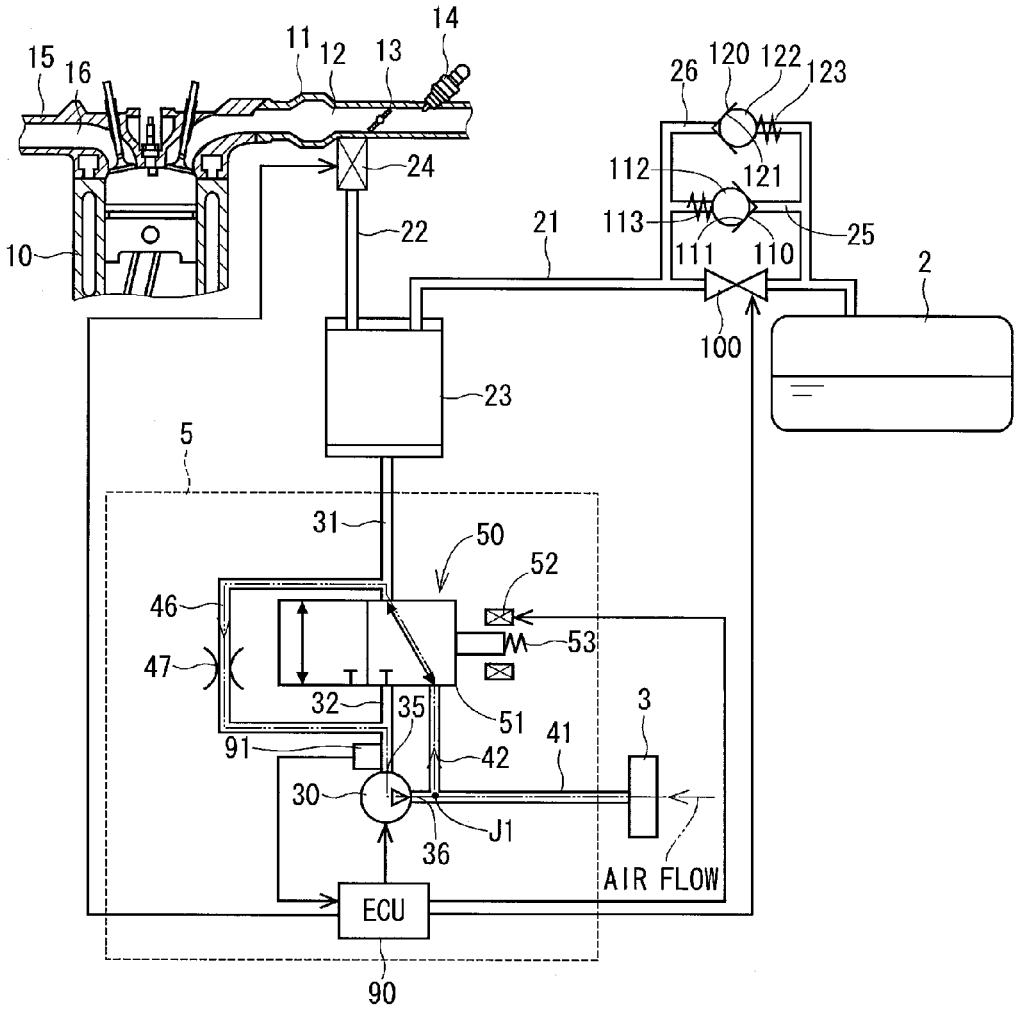
FIG. 7 is a schematic diagram showing a reference-pressure detection state of the fuel vapor purge device according to the comparative example.

As shown in FIG. 7, when operations of the vehicle and the engine 10 are stopped, and when temperatures of the engine 10 and the fuel tank 2 become stability temperatures lower than or equal to a predetermined value, the ECU 90 closes the purge valve 24. Additionally, the ECU 90 puts the switch valve 50 into OFF state to connect the first pump passage 31 and the second atmosphere passage 42, and operates the pump 30 such that fluid is drawn into the pump 30 through the fluid port 35 and the drawn fluid is discharged from the pump 30 through the fluid port 36. Accordingly, air flows into the first atmosphere passage 41 through the filter 3, and then passes through the second atmosphere passage 42, the switch valve 50, the first pump passage 31, the orifice passage 46, the orifice 47, the second pump passage 32, the pump 30 and the first atmosphere passage 41 in this order. Accordingly, an air flow can be provided, which circulates through the second atmosphere passage 42, the first pump passage 31, the orifice passage 46, the orifice 47, the second pump passage 32 and the first atmosphere passage 41. In this case, a pressure in the second pump passage 32 is comparable to an allowable internal pressure of the fuel tank 2. The allowable internal pressure is a pressure in the fuel tank 2 when the pump 30 depressurizes the interior of the fuel tank 2 in a case where the fuel tank 2 has an opening having a size corresponding to the allowable leakage amount of fuel vapor. Thus, the pressure in the second pump passage 32 detected by the pressure sensor 91 is stored in the RAM or another storage device by the ECU 90 as a reference pressure Ps that is negative pressure. The ECU 90 may open the control valve 100 when the reference pressure Ps is determined.

(Leakage Determination State)

Figure 8:
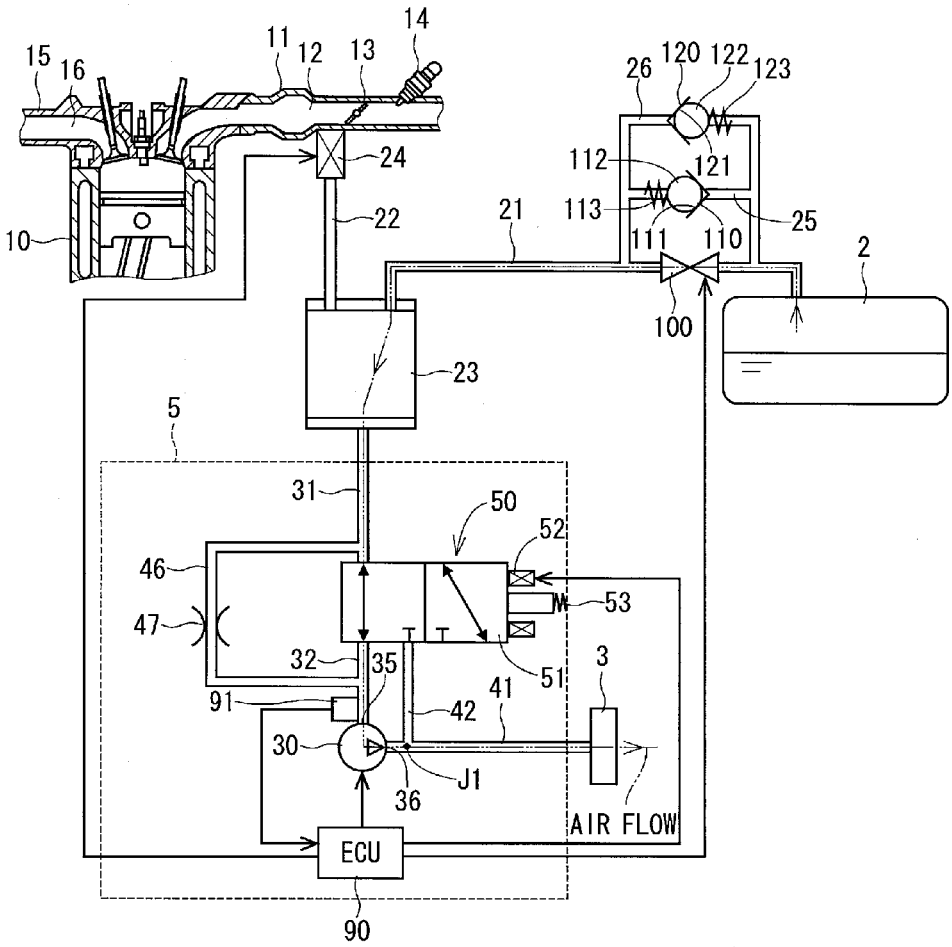
FIG. 8 is a schematic diagram showing a leakage determination state of the fuel vapor purge device according to the comparative example.

After the above-described detection of the reference pressure Ps, as shown in FIG. 8, the ECU 90 opens the control valve 100 and puts the switch valve 50 into ON state while operating the pump 30. Thus, air in the fuel tank 2 is discharged to the atmosphere through the purge passage 21, the first canister 23, the first pump passage 31, the switch valve 50, the second pump passage 32, the pump 30, the first atmosphere passage 41 and the filter 3. Therefore, the interior of the fuel tank 2 is depressurized. When the pressure in the second pump passage 32 detected by the pressure sensor 91 is lower than or equal to the reference pressure Ps, the ECU 90 determines that a leakage of fuel vapor from the fuel tank 2 is within an allowable range, in other words, the ECU 90 determines that fuel vapor in the fuel tank 2 does not leak. On the other hand, when the pressure in the second pump passage 32 detected by the pressure sensor 91 is higher than the reference pressure Ps, the ECU 90 determines that the leakage of fuel vapor from the fuel tank 2 exceeds the allowable range, in other words, the ECU 90 determines that fuel vapor leaks from the fuel tank 2. Accordingly, the ECU 90 operates the pump 30, opens the control valve 100, and puts the switch valve 50 into the ON state. Moreover, the ECU 90 determines whether the leakage of fuel vapor from the fuel tank 2 is within the allowable range based on the pressure (reference pressure Ps) detected by the pressure sensor 91.

As described above, in the comparative example, the control valve 100 that functions as the sealing device is an electromagnetic control valve which is required to be provided with an electromagnetic drive portion. Hence, the control valve 100 may have a relatively large body, and the fuel vapor purge device of the comparative example may become relatively large. In contrast, the seal valve 70 of the exemplar embodiment, which functions as the sealing device, is not required to be provided with a drive portion such as the electromagnetic drive portion. Thus, the seal valve 70 has a simple structure. Therefore, the fuel vapor purge device 1 of the exemplar embodiment can be made to be relatively small.

In the comparative example, the control valve 100, the check valve 110 and the check valve 120 are provided between the first canister 23 and the fuel tank 2. Hence, fuel vapor generated in the fuel tank 2 may attach to the control valve 100, the check valve 110 and the check valve 120, and may cause operational malfunctions of the control valve 100, the check valve 110 and the check valve 120. On the other hand, in the exemplar embodiment of the present disclosure, the first check valve 60, the seal valve 70, the second check valve 80 and other components are provided on an opposite side of the first canister 23 from the fuel tank 2. Therefore, it can be limited that fuel vapor generated in the fuel tank 2 attaches to the first check valve 60, the seal valve 70, the second check valve 80 and other components. As a result, operational malfunctions of the first check valve 60, the seal valve 70, the second check valve 80 and other components can be restricted.

(1) As described above, in the exemplar embodiment, the switch valve 50 connects the first pump passage 31 and the second pump passage 32 in the OFF state of the switch valve 50, or connects the first pump passage 31 and the second atmosphere passage 42 in the ON state of the switch valve 50. Since the first pump passage 31 is connected to the second pump passage 32 in the OFF state of the switch valve 50, the fuel tank 2 is connected to the second pump passage 32. When the pump 30 is not operated in this case, a pressure in the first pressure passage 43 is lower than the second pressure P2, and the seal valve 70 is closed to disconnect the second pump passage 32 from the third pump passage 33. Accordingly, communication between the interior of the fuel tank 2 and the atmosphere is blocked. When the switch valve 50 and the pump 30 are in the OFF states, the seal valve 70 functions as the sealing device that prevents discharge of fuel vapor from the fuel tank 2 to the atmosphere. Moreover, in the exemplar embodiment, when the internal pressure of the fuel tank 2 is excessively high, the pump 30 is operated to set the pressure in the first pressure passage 43 higher than or equal to the first pressure P1. Accordingly, the seal valve 70 and the first check valve 60 are opened, and the internal pressure of the fuel tank 2 can be thereby reduced. Consequently, breakage of the fuel tank 2 due to increase of the internal pressure of the fuel tank 2 can be restricted.

As described above, in the exemplar embodiment, the seal valve 70 is opened or closed automatically depending on the pressure in the first pressure passage 43 that changes due to operation of the pump 30. Hence, a drive portion, such as an electromagnetic drive portion, is not required for the seal valve 70. Therefore, the seal valve 70 can be simplified and downsized. Therefore, a body of the fuel vapor purge device 1 can be made to be smaller, and manufacturing cost thereof can be reduced. Additionally, the pump 30, the switch valve 50, the first check valve 60, the seal valve 70 and the second check valve 80 are provided on an opposite side of the first canister 23 from the fuel tank 2. Thus, it can be limited that fuel vapor generated in the fuel tank 2 attaches to the pump 30, the switch valve 50, the first check valve 60, the seal valve 70 and the second check valve 80. Operational malfunctions of the pump 30, the switch valve 50, the first check valve 60, the seal valve 70 and the second check valve 80 can be restricted.

(2) In the exemplar embodiment, the fuel vapor purge device 1 includes the second pressure passage 44. The first end of the second pressure passage 44 is connected to the first pump passage 31, and the second end of the second pressure passage 44 is connected to the switch valve 50. When a pressure in the second pressure passage 44 is higher than or equal to the third pressure P3 that is a predetermined positive value, the switch valve 50 can be operated to connect the first pump passage 31 and the second atmosphere passage 42. Because of the second pressure passage 44, the switch valve 50 can be operated to connect the first pump passage 31 and the second atmosphere passage 42 without supply of electricity to the switch valve 50 when the internal pressure of the fuel tank 2 becomes an excess positive pressure (i.e., the internal pressure of the fuel tank 2 becomes higher than or equal to the third pressure P3). The internal pressure (positive pressure) of the fuel tank 2 can be released (depressurized) to the atmosphere, and the internal pressure of the fuel tank 2 can be thereby reduced. Accordingly, breakage of the fuel tank 2 due to increase of a difference between the internal pressure (positive pressure) of the fuel tank 2 and the atmosphere pressure can be restricted.

(3) In the exemplar embodiment, the fuel vapor purge device 1 includes the connection passage 45 and the second check valve 80. The connection passage 45 connects the second pump passage 32 and the second atmosphere passage 42. The second check valve 80 is provided in the connection passage 45, and is open when a pressure in the connection passage 45 between the second pump passage 32 and the second check valve 80 is lower than or equal to the fourth pressure P4 that is a predetermined negative value. Accordingly, a flow of fluid from the second atmosphere passage 42 toward the second pump passage 32 is allowed. On the other hand, when the pressure in the connection passage 45 between the second pump passage 32 and the second check valve 80 is higher than the fourth pressure P4, the second check valve 80 is closed to block the flow of fluid from the second atmosphere passage 42 toward the second pump passage 32. When the internal pressure of the fuel tank 2 becomes an excess negative pressure (i.e., the internal pressure of the fuel tank 2 becomes lower than or equal to the fourth pressure P4), the second check valve 80 is opened to allow the flow of fluid from the second atmosphere passage 42 to the second pump passage 32. By opening of the second check valve 80, the internal pressure (negative pressure) of the fuel tank 2 can be released to the atmosphere, and the internal pressure of the fuel tank 2 can be increased. Accordingly, breakage of the fuel tank 2 due to increase of a difference between the internal pressure (negative pressure) of the fuel tank 2 and the atmosphere pressure can be restricted.

(4) In the exemplar embodiment, the fuel vapor purge device 1 includes the second canister 4 located in the first atmosphere passage 41 between the second end of the first atmosphere passage 41 and the connection point J1 at which the first atmosphere passage 41 is connected to the second atmosphere passage 42. The second canister 4 is capable of adsorbing and holding fuel vapor desorbed from the first canister 23. In the exemplar embodiment, the first canister 23 is provided to restrict attachment of fuel vapor to the pump 30 or other components. However, the first canister 23 may be damaged when the fuel tank 2 is sealed and when the vehicle is stopped. When the pressure release or the fuel-vapor leakage determination is performed while the fuel tank 2 is damaged, the fuel vapor may be discharged to the atmosphere. Since the fuel vapor purge device 1 includes the second canister 4 in addition to the first canister 23, such discharge of the fuel vapor to the atmosphere can be prevented certainly.

(5) In the present embodiment, the fuel vapor purge device 1 includes the pressure sensor 91 capable of detecting a pressure in the second pump passage 32. The ECU 90 is capable of determining whether a leakage of fuel vapor from the fuel tank 2 is within the allowable range based on a pressure (reference pressure Ps) that is detected by the pressure sensor 91 while the first check valve 60 and the seal valve 70 are opened by operating the pump 30.

Although the present disclosure has been fully described in connection with the preferred embodiments thereof with reference to the accompanying drawings, it is to be noted that various changes and modifications described below will become apparent to those skilled in the art.

The second canister 4 may be omitted. In this case, a capacity of the first canister 23 may be made to be sufficient so as not to be broken. The internal pressure of the fuel tank 2 may be set to be negative slightly, and accordingly an amount of fuel vapor possibly discharged from the fuel tank 2 to the atmosphere in the pressure release or the fuel-vapor leakage determination can be limited. Additionally, the ECU 90 may monitor an open/closed state of a fueling lid (tank lid), a pressure detected by the pressure sensor 91, and an open/closed state of the purge valve 24. The monitor results may be utilized to restrict the release of the internal pressure of the fuel tank 2 and to restrict the fuel-vapor leakage determination when the first canister 23 is broken. A durable pressure of the fuel tank 2 may be increased, and the pressure release of the fuel tank 2 may be prohibited if the first canister 23 is broken. Or, the fuel tank 2 may be sealed, and the internal pressure of the fuel tank 2 is generally kept negative by using the pump 30, in order to prevent the pressure release due to increase of the internal pressure of the fuel tank 2, for example, when the vehicle is stopped. The fuel-vapor leakage determination may be canceled, in other words, the pump 30 may not be operated, when the first canister 23 is suspected to be broken. The fuel-vapor leakage determination may be canceled when the vehicle is parked for a long time after fueling, for example.

In the above-described embodiment, the pump 30 is operated to depressurize the interior of the fuel tank 2, in other words, the pump 30 draws fluid therein through the fluid port 35 and discharge fluid through the fluid port 36 when the reference pressure is detected and when the fuel vapor leakage is determined. However, the pump 30 may be operated to pressurize the interior of the fuel tank 2, in other words, the pump 30 fluid therein through the fluid port 36 and discharge fluid through the fluid port 35 when the reference pressure is detected and when the fuel vapor leakage is determined. In this case, the seal valve 70 and the first check valve 60 are arranged oppositely from the above-described embodiment, in other words, positions of the urging members and the valve seats are exchanged. When the pump 30 is operated in this case, the third pump passage 33 is pressurized, and the first pressure passage 43 is depressurized. The negative pressure in the first pressure passage 43 causes the seal valve 70 to be open. When the pressure in the first pressure passage 43 becomes more negative subsequently, the first check valve 60 is opened. Because of the change of the positions of the valve seats and the valve elements, the seal valve 70 and the first check valve 60 can be opened even when the pump 30 is operated to pressurize the interior of the fuel tank 2.

The position of the pressure detection device (91) is not limited, and the pressure detection device may be provided in the fuel tank 2, the purge passage 21, 22, the first canister 23, the first pump passage 31 or the third pump passage 33. Moreover, the pressure detection device, the orifice passage 46 and the orifice 47 may be omitted. Thus, the fuel vapor purge device 1 may not include the fuel-vapor leakage detection device 5. The fuel vapor purge device 1 may not include at least one of the second pressure passage 44, the connection passage 45 and the second check valve 80. The present disclosure is not limited to the above-described embodiment, and can be applied for various embodiments without departing from the scope of the present disclosure.

Additional advantages and modifications will readily occur to those skilled in the art. The disclosure in its broader terms is therefore not limited to the specific details, representative apparatus, and illustrative examples shown and described.

What is claimed is:

1. A fuel vapor purge device which purges fuel vapor generated in a fuel tank by introducing the fuel vapor into an internal combustion engine, the fuel vapor purge device comprising:

a purge passage connecting the fuel tank and an intake passage through which intake air is introduced into the internal combustion engine;

a first canister provided in the purge passage to adsorb and hold a part of the fuel vapor flowing in the purge passage;

a purge valve provided in the purge passage near the intake passage to open or close the purge passage;

a first pump passage having a first end connected to the first canister;

a second pump passage having a first end capable of being connected to a second end of the first pump passage;

a third pump passage having a first end capable of being connected to a second end of the second pump passage;

a pump connected to a second end of the third pump passage, wherein the pump is capable of depressurizing or pressurizing an interior of the fuel tank through the third pump passage, the second pump passage, the first pump passage, the first canister and the purge passage;

a first atmosphere passage having a first end connected to the pump, and a second end open to an atmosphere;

a second atmosphere passage having a first end connected to the first atmosphere passage at a connection point;

a switch valve provided among the second end of the first pump passage, the first end of the second pump passage and a second end of the second atmosphere passage, wherein the switch valve switches connection of the first pump passage between with the second pump passage and with the second atmosphere passage;

a first check valve provided in the first atmosphere passage between the pump and the connection point, wherein the first check valve is open to allow a flow of fluid from the pump toward the atmosphere when a pressure between the first check valve and the pump in the first atmosphere passage is higher than or equal to a first pressure that is a predetermined positive value, and the first check valve is closed to block a flow of fluid from the atmosphere toward the pump when the pressure between the first check valve and the pump in the first atmosphere passage is lower than the first pressure;

a first pressure passage having a first end connected to a part of the first atmosphere passage between the pump and the first check valve, the first pressure passage being pressurized or depressurized by operation of the pump;

a seal valve provided among the second end of the second pump passage, the first end of the third pump passage and a second end of the first pressure passage, wherein the seal valve is open to connect the second pump passage and the third pump passage when a pressure in the first pressure passage is higher than or equal to a second pressure that is a predetermined positive value lower than the first pressure, the seal valve is closed to disconnect the second pump passage from the third pump passage so as to block communication between the interior of the fuel tank and the atmosphere when the pressure in the first pressure passage is lower than the second pressure; and a control device provided to be capable of controlling operations of the purge valve, the pump and the switch valve, wherein the control device is capable of introducing fuel vapor adsorbed to the first canister into the internal combustion engine through the intake passage by opening the purge valve and by controlling the switch valve to connect the first pump passage and the second atmosphere passage.

2. The fuel vapor purge device according to claim 1, further comprising a second pressure passage having a first end connected to the first pump passage, and a second end connected to the switch valve, wherein the switch valve can be operated to connect the first pump passage and the second atmosphere passage when a pressure in the second pressure passage is higher than or equal to a third pressure that is a predetermined positive value.

3. The fuel vapor purge device according to claim 1, further comprising:

a connection passage connecting the second pump passage and the second atmosphere passage; and a second check valve provided in the connection passage, wherein the second check valve is open to allow a flow of fluid from the second atmosphere passage toward the second pump passage when a pressure in the connection passage between the second check valve and the second pump passage is lower than or equal to a fourth pressure that is a predetermined negative value, and the second check valve is closed to block a flow of fluid from the second pump passage toward the second atmosphere passage when the pressure in the connection passage between the second check valve and the second pump passage is higher than the fourth pressure.

4. The fuel vapor purge device according to claim 1, further comprising a second canister provided in the first atmosphere passage between the connection point and the second end of the first atmosphere passage to be capable of adsorbing and holding fuel vapor desorbed from the first canister.

5. The fuel vapor purge device according to claim 1, further comprising a pressure detection device capable of detecting a pressure in the fuel tank, the purge passage, the first canister, the first pump passage, the second pump passage or the third pump passage, wherein the control device determines whether a leakage amount of fuel vapor from the fuel tank is within an allowable range based on the pressure which is detected by the pressure detection device while the first check valve and the seal valve are opened by operation of the pump.

6. A fuel vapor purge device which purges fuel vapor generated in a fuel tank by introducing the fuel vapor into an internal combustion engine, the fuel vapor purge device comprising:

a canister connected to the internal combustion engine and the fuel tank via a purge passage to adsorb and hold a part of the fuel vapor flowing in the purge passage;

a switch valve connected to the canister and to an atmosphere;

a pump connected to the switch valve via a pump passage, and to the atmosphere via an atmosphere passage; and a seal valve provided in the pump passage to open or close the pump passage depending on a pressure in the atmosphere passage, wherein the pump is capable of depressurizing or pressurizing an interior of the fuel tank through the pump passage, the switch valve, the canister and the purge passage, and the switch valve switches connection of the canister between with the atmosphere and with the pump.

7. The fuel vapor purge device according to claim 6, wherein the seal valve opens the pump passage when the switch valve connects the canister and the pump, and when the pressure in the atmosphere passage is higher than or equal to a predetermined positive pressure, and the seal valve closes the pump passage when the switch valve connects the canister and the pump, and when the pressure in the atmosphere passage is lower than the predetermined positive pressure.

8. The fuel vapor purge device according to claim 6, further comprising a pressure passage having a first end connected to the canister, and a second end connected to the switch valve, wherein the switch valve can be operated to connect the canister and the atmosphere when a pressure in the pressure passage is higher than or equal to a predetermined positive pressure.

9. The fuel vapor purge device according to claim 6, wherein the canister is directly connected to the fuel tank via the purge passage.

* * * * *